US008579032B2

(12) United States Patent
Fenton

(10) Patent No.: US 8,579,032 B2
(45) Date of Patent: Nov. 12, 2013

(54) CASING ANNULUS MANAGEMENT

(75) Inventor: Stephen P. Fenton, Balmedie (GB)

(73) Assignee: Vetco Gray Inc., Houston, TX (US)

( * ) Notice: Subject to any disclaimer, the term of this patent is extended or adjusted under 35 U.S.C. 154(b) by 440 days.

(21) Appl. No.: 12/883,534

(22) Filed: Sep. 16, 2010

(65) Prior Publication Data

US 2011/0114333 A1 May 19, 2011

Related U.S. Application Data

(60) Provisional application No. 61/261,882, filed on Nov. 17, 2009.

(51) Int. Cl.
*E21B 34/02* (2006.01)

(52) U.S. Cl.
USPC ..... 166/321; 166/325; 166/373

(58) Field of Classification Search
USPC ..... 166/373, 321, 325
See application file for complete search history.

(56) References Cited

U.S. PATENT DOCUMENTS

| | | | | |
|---|---|---|---|---|
| 4,632,188 | A | 12/1986 | Schuh et al. | |
| 6,840,323 | B2 | 1/2005 | Fenton | |
| 7,219,741 | B2 | 5/2007 | Fenton | |
| 7,240,739 | B2 * | 7/2007 | Schoonderbeek et al. | 166/386 |
| 2002/0074127 | A1 * | 6/2002 | Birckhead et al. | 166/372 |
| 2003/0010503 | A1 | 1/2003 | Staudt | |
| 2005/0189107 | A1 | 9/2005 | McVay et al. | |

OTHER PUBLICATIONS

The GB Search Report issued in connection with corresponding GB Application No. GB1019091.6 on Jan. 20, 2011.

* cited by examiner

*Primary Examiner* — Brad Harcourt
(74) *Attorney, Agent, or Firm* — Bracewell & Giuliani LLP

(57) ABSTRACT

A wellbore tubular set concentrically between an inner an and outer annulus has a pressure relief valve that opens when pressure in the outer annulus exceeds pressure in the inner annulus by an amount that can damage the tubular. The relief valve closes and reseats when the pressure differential is reduced to below the damaging threshold. The relief valve can include a spring for reseating the valve. A pressure gauge can be included within the outer annulus for monitoring whether or not the relief valve is operating properly.

10 Claims, 2 Drawing Sheets

CASING ANNULUS MANAGEMENT

CROSS REFERENCE TO RELATED APPLICATIONS

This application claims priority to and the benefit of co-pending U.S. Provisional Application Set. No. 61/261,882, filed Nov. 17, 2009, the full disclosure of which is hereby incorporated by reference herein.

1. FIELD OF THE INVENTION

This invention relates in general to production of oil and gas wells, and in particular to an automated vent system that prevents overpressure within an annulus in a wellhead assembly.

2. DESCRIPTION OF RELATED ART

Systems for producing oil and gas from subsea wellbores typically include a wellhead assembly that includes a wellhead housing attached at a wellbore opening, where the wellbore extends through one or more hydrocarbon producing formations. Casing and a tubing hanger are landed within the housing for supporting casing and production tubing inserted into the wellbore. The wellhead assembly may include strings of concentrically arranged casing, such as conductor pipe, surface casing, and an inner casing. Generally, the inner casing goes deeper than the conductor pipe and surface casing and lines the wellbore to isolate the wellbore from the surrounding formation. Tubing typically lies concentric within the inner casing and provides a conduit for producing the hydrocarbons entrained within the formation. Annuli are defined between each pair of adjacent concentric tubulars, where each annulus is sealed from pressure communication with any of the other annuli. If an annulus becomes unexpectedly pressurized, such as from a leak or thermal expansion of fluids contained and constrained within the annuli, a pressure differential will develop across a tubular wall adjacent the pressurized annulus. Thus a need exists to periodically monitor the pressure in certain tubular members in well installations, both on land and at sea.

Checking the pressure in the inner wellhead housing would indicate whether or not any casing leakage or thermal loading has occurred. Subsea wells do not monitor pressure because installing a pressure sensor requires drilling a hole through the sidewall of the inner wellhead housing, which is operationally non-preferred from a pressure integrity standpoint. Further, because of the harsh and corrosive environments often encountered in petroleum well installations, an installed pressure sensor may succumb to the damaging effects and no longer perform.

SUMMARY OF THE INVENTION

Disclosed herein is a wellhead assembly that includes a pressure vent device that vents between concentric annuli when the pressure differential reaches or exceeds a pre-designated value. In an example embodiment the wellhead assembly includes an inner annulus set in a wellbore that is surrounded by an outer annulus. A tubular is between the inner and outer annuli that has a relief valve set in a sidewall. When closed, the relief valve forms a pressure seal between the inner annulus and outer annulus. The relief valve can selectively opened to allow venting from the higher pressure of the inner annulus and outer annulus. After the inner and outer annuli are substantially pressure equalized, the relief valve then closes. A designated pressure differential between the inner annulus and outer annulus can cause the relief valve to open. In an example embodiment, the relief valve includes a valve seat having a surface in pressure communication with one of the inner annulus or the outer annulus and that is biased to a closed position by a spring. The wellhead assembly may also include a passage leading through the wellhead from one of the annuli. Optionally, a pressure sensor can be set in one of the inner annulus or outer annulus. In an alternative embodiment, the inner annulus can be a tubing annulus and the outer annulus can be a casing annul us and the pressure relief valve allows flow from the casing annulus to the tubing annulus when in the open position. In an alternate example, the wellhead assembly includes a blocking sleeve selectively mounted within one of the annuli and into sealing contact with a vent side of the relief valve to block flow through the relief valve.

Also disclosed herein is a method of managing wellbore annulus pressure, in an example embodiment the method involves suspending a tubular in the wellbore that creates an inner annulus in the tubular and an outer annulus around the tubular. In the example method the tubular has a vent valve set in its sidewall, the vent valve opens in response to a pressure difference across the sidewall of the tubular. The pressure difference can be created when one of the inner annulus or outer annulus experiences an increase in pressure. The vent valve opens when the pressure difference is above a designated pressure differential. When open, pressure vents across the tubular to equalize the pressure in the inner and outer annuli. Thus when the pressure difference between the annuli falls below a set value, the vent valve closes. This example can also include monitoring pressure in the inner or outer annulus via non-intrusive means. The inner annulus can be a tubing annulus and the outer annulus can be a casing annulus. In an example embodiment, the annulus having a higher pressure is the outer annulus. In an alternative step, a bridging sleeve may be set in the tubular adjacent the vent valve to override the vent valve function. The wellhead assembly can include a vent passage for venting flow from the inner or outer annulus having the higher pressure through a wellhead and out of the wellbore.

An alternative embodiment of a wellhead assembly is described herein that is set over a well. Tubing is suspended in the well and circumscribed by a string of inner casing, that is surrounded by a string of outer casing. The tubing and inner and outer casings define an inner annulus between the tubing and inner casing and an outer annulus between the inner and outer strings casing. Also included is a pressure relief valve set in a passage in a side wall of the inner casing that blocks flow through the passage when a pressure difference between the inner annul us and outer annulus is less than a designated pressure differential and is selectively moveable out of the passage when a pressure difference between the inner annulus and outer annulus is greater than a designated pressure differential so that flow communicates through the passage from the outer annulus to the inner annulus. Optionally included with the wellhead assembly is a tubing annuls passage leads from the inner annuls and to an exterior of the wellhead assembly. Yet further optionally, a pressure sensor can be included in one of the inner annulus or outer annulus. Communication between the outer annulus and the exterior of the wellhead assembly may be limited to a flow path through the pressure relief valve. A blocking sleeve can be included that is selectively installable within the tubing annulus and into sealing contact with a side of the passage (during for instance a planned well workover).

DETAILED DESCRIPTION OF THE INVENTION

Figure 1:
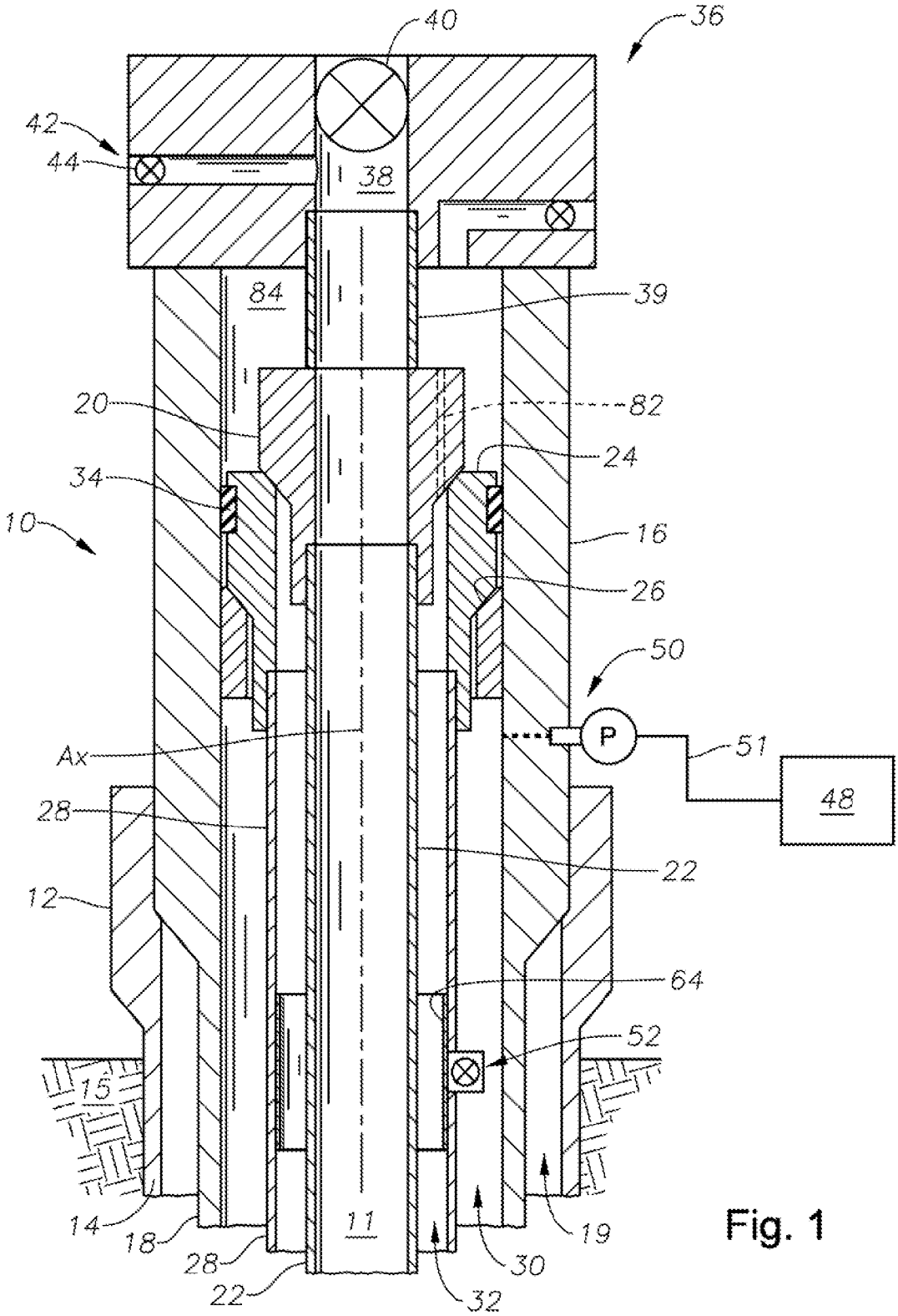
FIG. 1 is a schematic partial cross sectional view of an embodiment of a wellhead assembly having an automated vent system.

FIG. 1 provides a side partial cross-sectional view of an embodiment of a wellhead assembly 10 in accordance with the present disclosure. The wellhead assembly 10 can be used with a subsea well for controlling production fluid from within a hydrocarbon producing wellbore 11. An outer wellhead housing 12 is provided having an annular outer conductor pipe 14 extending from its bottom end into formation 15 intersected by the wellbore. Coaxially disposed within the outer wellhead housing 12 is a high pressure/inner wellhead housing 16. A string of surface casing 18 depends downward from the inner wellhead housing 16 and coaxial within the outer conductor pipe 14. An outer annulus 19 is formed between the outer conductor pipe 14 and surface casing 18.

The wellhead housing 16 coaxially circumscribes a tubing hanger 20 and production tubing 22 supported by the tubing hanger 20. A casing hanger 24 is also coaxially landed on a shoulder 26 within the wellhead housing 16. The shoulder 26 is formed on the inner radius of the wellhead housing 16 and projects inward towards the wellhead assembly axis $A_X$. Casing 28, which is supported from the bottom end of the casing hanger 24, depends downward circumscribing the production tubing 22. The casing 28 defines a casing annulus 30 between it and the wellhead housing 16 and surface casing 18. A tubing annulus 32 is defined between the casing 28 and tubing 22. A seal 34 is shown disposed, in the space between the casing hanger 24 and high pressure housing 16, thereby isolating the casing annulus 30 from the tubing annulus 32.

A typical production tree 36 is shown mounted on the upper end of the high pressure housing 16; although this may take many alternative forms and is not intrinsic to the disclosure. The production tree 36 includes a main bore 38 that is axially formed through the production tree 36 and in fluid communication with the production tubing 22. A sealingly engaged sleeve 39 projects between the upper end of the tubing hanger 20 and the main bore 38. The main bore 38 is selectively opened or closed with a swab valve 40 shown disposed at its upper end. A production port 42 projects laterally from the main bore 38 through the outer circumference of the production tree 36. Flow through the production port 42 is regulated with an inline wing valve 44.

The pressure rating of the outer conductor pipe 14 and outer wellhead housing 12 is less than the surface casing 18 and high pressure wellhead housing 16. Pressure rating of the intermediate casing 28 is compatible with the pressure rating of the surface casing 18 and often higher. However, a leak may occur in the intermediate casing 28 or associated seals (typified by 34) and/or (most probably) thermal transients can cause undue pressure to become present in the annulus 30. Under some conditions, this can cause collapse of the casing 28 (i.e. if caused by thermal transient conditions) or rupture of surface casing 18 releasing wellbore fluids directly to the adjacent environment in the latter case An optional pressure sensor 50 is shown mounted on the outer conductor pipe 14. The pressure sensor 50 would typically be a non-intrusive device, capable of monitoring pressure level in the annulus 30 without being in direct communication with the annulus 30. An example of a sensor 50 is depicted in U.S. Pat. No. 5,492,017 assigned to the assignee of the present application. Measurements made by the pressure sensor 50 can be conveyed to the controller 48 via a communication link 51 connected between the sensor 50 and controller 48

Figure 2:
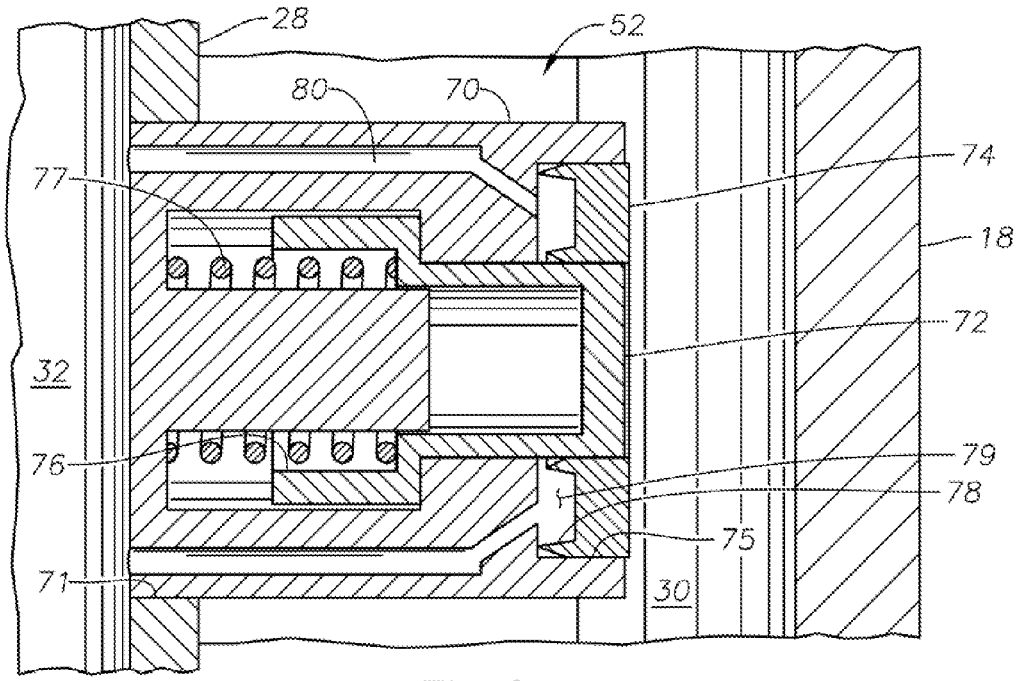
FIG. 2 is a schematic side sectional view of a vent valve in, a closed position.

A vent valve 52 is illustrated that selectively allows communication through the intermediate casing 28 between the outer annulus 30 and inner annulus 32. In this embodiment, the vent valve 52 operates as a pressure relief valve and opens at a specific set pressure to allow communication between the casing annulus 30 and tubing annulus 32. An embodiment of the vent valve 52 is shown in a side sectional view in FIG. 2, wherein the valve 52 includes a cylindrical body 70 set in a port 71 formed through the casing 28. The valve 52 may also be mounted in a special casing sub or coupling (not shown). In the embodiment of FIG. 2, the body 70 has an inner end substantially flush, with the internal surface of the casing 28 facing the tubing annulus 32. An outer end of the body 70 projects into the casing annulus 30.

Still referring to FIG. 2, a valve seat 72 is shown coaxially provided in the body 70 set in a profiled channel on the side of the body 70 in the casing annulus 30. The valve seat 72 mid section is cylindrical having an open end facing the casing 28. The valve seat 72 includes an "L" shaped flange that projects radially outward from the open end of the mid section and then extends axially away from the mid section and towards the casing 28. A ring shaped metal seal 74 is set in the body 70 in a groove 75 shown circumscribing the mid section of the valve seat 72 to form a sealing surface between the valve seat 72 and body 70. An annular cavity 76 is shown in the body 70 oriented transverse to the casing 28; a spring 77 is disposed in the cavity 76. The spring 77 extends between the end of cavity 76 proximate the casing 28 and to the portion of the valve seat 72 projecting radially outward from the opening at the mid-section. Thus when compressed, the spring 77 pushes the valve seat 72 away from the casing 28.

Figure 3:
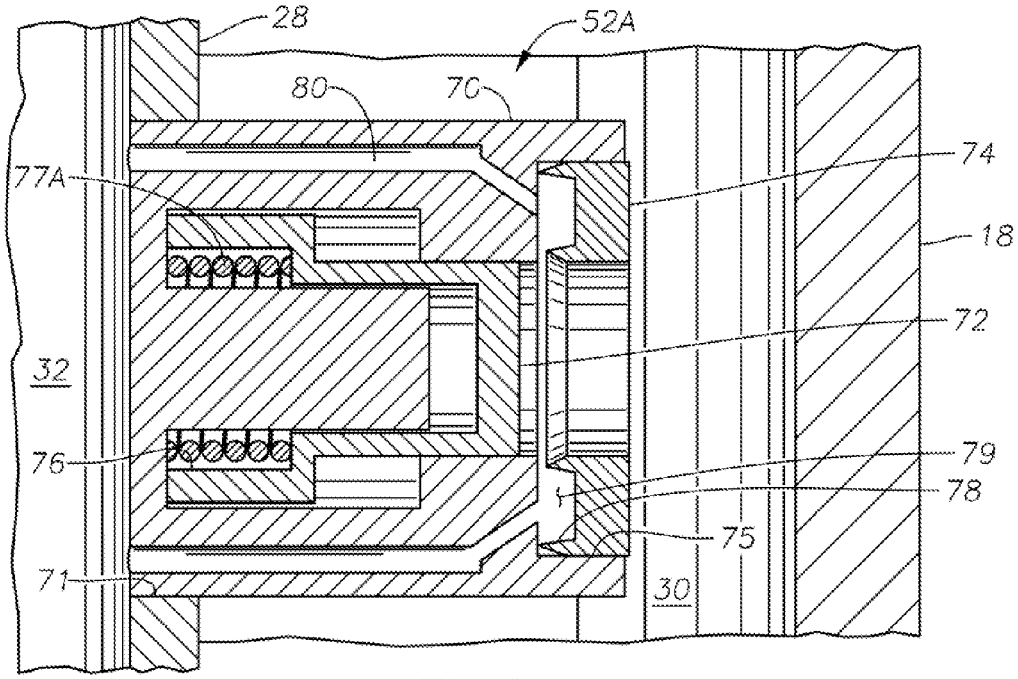
FIG. 3 illustrates the vent valve of FIG. 2 in a open position.

A channel 78 is formed in the side of the seal 74 opposite the casing annulus 30 thereby defining a space 79 between the seal 74 and bottom of the groove 75. Flow passages 80 are shown in the body 70 that provide communication between the space 79 and the tubing annulus 32. The sealing interface between the seal 74 and valve seat 72 and body 70 as shown in FIG. 2 blocks pressure communication between the space 79 and the casing annulus 30. The passages 80 in the body 70 puts the side of the valve seat 72 facing the casing 28 in pressure communication with the tubing annulus 32. The valve seat 72 is therefore exposed to any pressure differentials that may occur between the casing annulus 30 and tubing annulus 32. Thus if the pressure in the casing annulus 30 sufficiently exceeds the pressure in the tubing annulus 32, so that a resultant force is applied to the valve seat 72 that overcomes the force in the spring 77. As depicted in the schematic of FIG. 3, the pressure differential will push the valve seat 72 inward and compress the spring 77A. Continued movement of the valve seat 72 eventually moves the mid-section of the valve seat 72 past the seal 74 thereby removing the sealing interface between the valve seat 72 and seal 74. As such, the casing annulus 30 is in pressure communication with the tubing annulus 32 via a path that that travels through the space 79 and passage 80. The path allows the higher pressurize fluid in the casing annulus 30 to flow through the valve 52A to the tubing annulus 32.

Fluid flow during venting from the casing annulus 30 to the tubing annulus 32 reduces the pressure in the casing annulus 30; and also reduces the pressure differential between the easing annulus 30 and the tubing annulus 32. Removing the pressure different allows the spring 77 to reseat the valve seat 72 and reinstate the sealing interface as illustrated in FIG. 2. This would be typified by a nominal relief setting of 500 psi on the valve, the actual value being predetermined by operator preference.

In one example of use, when pressure in the casing annulus 30 approaches a designated pressure that may potentially damage wellbore assembly 10 hardware, the vent valve 52, automatically reverts to the open position of FIG. 3 (casing annulus 30 vented into tubing annulus 32) until pressure in the casing annulus 30 is below a potentially damaging pressure. The casing annulus 30 is vented until the pressure therein is no greater than 500 pounds per square inch (or some other value of the pressure setting of the valve 52) less than the minimum differential rating of the wellhead assembly 10 and surface casing 18 when considered together. Optionally, the pressure could be reduced yet further (for instance down to ambient pressure) in an attempt to compensate for a slow leak downhole past for instance a production packer (not shown) or tubing joint.

As a contingency, later in field life if desired, during for instance recompletion, the vent valve 52 can be overridden by installation of a contingency "patch" or sleeve 64 (FIG. 1) inside the intermediate casing 18, bridging the vent assembly. The blocking sleeve 64 is shown coaxially within the casing 28 and illustrated at an axial location adjacent the vent valve 52. This sleeve 64 may be set in a number of ways that are typified by casing patch technology, more recent versions of this being as typified by expandable tubular systems, wherein metal casing is plastically deformed to expand out radially into contact with the casing inner diameter.

In an alternative embodiment, the production tree 36 includes an annulus line 82 that extends from the tubing annulus 32, through the tubing hanger 20, and to the annular space 84 between the tubing hanger 20 and the production tree 36. The annulus line 82 has a valve that can be opened to bleed off pressure it receives from the pressurized (or leaking) casing annulus 30 in an example of use, the valve 52 allows flow only from the casing annulus 30 to the tubing annulus 32, and not vice-versa. As indicated above, the casing annulus 30 is closed and sealed at its supper end by the seal 34, also referred to as a casing hanger packoff. Optionally, the production tree 36 could be in a horizontal configuration, in which case the tubing annulus line 82 would bypass the tubing hanger 20.

While the invention has been shown or described in only some of its forms, it should be apparent to those skilled in the art that it is not so limited, but is susceptible to various changes without departing from the scope of the invention. For example, the vent valve 52 can be of the form found in Fenton et al. U.S. Pat. No. 6,840,323, which is assigned to the assignee of the present application and incorporated by reference herein. Optionally, the vent valve 52 can be made of a valve member urged closed by a resilient member, such as a spring, that compresses in response to a designated pressure differential.

What is claimed is:

1. A wellhead assembly comprising:
an inner annulus in a wellbore;
an outer annulus circumscribing the inner annulus;
a tubular between the inner and outer annuli;
a port formed in a sidewall of the tubular; and
a relief valve comprising:
a body mounted in the port and projecting radially outward from the tubular,
a flow passage in the body having an inner radial end in communication with the inner annulus and an outer radial end radially distal from the inner radial end,
a groove formed in an end of the body distal from the port and that is substantially coaxial with the port,
a valve seat in the body that is biased by a spring to a closed position between the outer radial end and outer annulus, and moveable to an open position set radially inward from the closed position and spaced away from a flow path between the outer radial end and outer annulus, the valve seat further comprising an upper portion having a substantially cylindrical outer surface that selectively moves into the groove when the valve seat is in the closed position, a lower portion having a substantially cylindrical outer surface with a radius exceeding a radius of the upper portion, and a surface in pressure communication with the outer annulus, so that when the valve seat is in the closed position, the valve seat defines a flow barrier between the inner annulus and outer annulus, and when the valve seat is in the open position, the outer radius is in communication with the inner radius through the flow passage and flow path.

2. The wellhead assembly of claim 1, wherein the valve seat is selectively moveable between the open and closed positions in response to a designated pressure differential between the inner annulus and outer annulus.

3. The wellhead assembly of claim 1, further comprising a pressure sensor in one of the inner annulus or outer annulus.

4. The wellhead assembly of claim 1, wherein the inner annulus is a tubing annulus and the outer annulus is a casing annulus and the pressure relief valve allows flow from the casing annulus to the tubing annulus when in the open position.

5. The wellhead assembly of claim 1, further comprising a blocking sleeve selectively mounted within one of the annuli and into sealing contact with a vent side of the relief valve to block flow through the relief valve.

6. A wellhead assembly set on a well comprising:
a string of tubing suspended in the well;
a string of inner casing surrounding the string of tubing in the well;
a string of outer casing surrounding the string of inner casing;
an inner annulus in a wellbore between the string of tubing and the string of casing;
an outer annulus between the inner and outer strings of casing; and
a pressure relief valve comprising:
a body set in a in a port formed in a side wall of the inner casing,
a passage in the body that extends radially outward from the inner casing,
a valve seat oriented substantially coaxially with the port and moveable between a closed position and between an outer radial end of the passage and the outer annulus to an open position set radially inward from the closed position, and
an annular groove formed in an end of the valve seat distal from the inner casing and that is substantially coaxial with the port,
so that when the valve seat is in the open position the inner radius communicates with the outer radius through the passage.

7. The wellhead assembly of claim 6, further comprising an annular seal set in the groove having an inner radius that is in selective contact with an outer radial surface of the valve seat to define a sealing interface when the valve seat is in the closed position tubing annulus.

8. The wellhead assembly of claim 6, further comprising a pressure sensor in one of the inner annulus or outer annulus.

9. The wellhead assembly of claim 6, wherein communication between the outer annulus and the exterior of the wellhead assembly consists of a flow path through the pressure relief valve.

10. The wellhead assembly of claim 6, further comprising a blocking sleeve selectively moveable within the inner annulus and into sealing contact with a side of the passage.

* * * * *